US009061290B1

(12) United States Patent
Brown, II

(10) Patent No.: US 9,061,290 B1
(45) Date of Patent: Jun. 23, 2015

(54) INTAKE OR EXHAUST GAS PARTICLE REMOVAL APPARATUS

(76) Inventor: Raymond T. Brown, II, Lighthouse Point, FL (US)

( * ) Notice: Subject to any disclaimer, the term of this patent is extended or adjusted under 35 U.S.C. 154(b) by 742 days.

(21) Appl. No.: 12/660,565

(22) Filed: Mar. 1, 2010

(51) Int. Cl.
*B03C 3/00* (2006.01)
*B03C 3/49* (2006.01)
*B03C 3/68* (2006.01)

(52) U.S. Cl.
CPC ..... *B03C 3/49* (2013.01); *F01N 2240/04* (2013.01); *B03C 3/68* (2013.01); *B03C 2201/30* (2013.01); *F01N 2490/16* (2013.01)

(58) Field of Classification Search
USPC ..... 96/61; 95/78; 60/275, 311
See application file for complete search history.

(56) References Cited

U.S. PATENT DOCUMENTS 2,711,226 A * 6/1955 Davis, Jr. ..... 96/61
4,973,341 A * 11/1990 Richerson ..... 96/61
5,591,253 A * 1/1997 Altman et al. ..... 96/61
6,017,381 A * 1/2000 Dunn et al. ..... 95/3
6,221,136 B1 * 4/2001 Liu et al. ..... 96/66
6,858,064 B2 * 2/2005 Bologa et al. ..... 95/65
7,377,957 B2 * 5/2008 Rosenberg ..... 95/63
2007/0254250 A1 * 11/2007 Evans-Beauchamp ..... 431/5
2009/0277325 A1 * 11/2009 Gottung et al. ..... 95/8

* cited by examiner

*Primary Examiner* — Duane Smith
*Assistant Examiner* — Sonji Turner
(74) *Attorney, Agent, or Firm* — Frank L. Kubler

(57) ABSTRACT

A particle removal apparatus is provided for connection to an internal combustion engine air intake line or exhaust line to remove particles from flowing gas, including an electrically conductive first spiral plate which spirals around and longitudinally along and is secured to the exterior surface of the electrically conductive disposal tube having a particle admitting tube opening; and an electrically conductive second spiral plate which spirals within and longitudinally along and is secured to the interior surface of an electrically conductive outer mounting tube, the second spiral plate spiraling parallel to and spaced apart a selected distance from the first spiral plate; so that the particles become charged and collect on one of the plates and subsequently enter the disposal tube. The outer mounting tube preferably is a tubular side wall of a containment housing.

14 Claims, 25 Drawing Sheets

INTAKE OR EXHAUST GAS PARTICLE REMOVAL APPARATUS

BACKGROUND OF THE INVENTION

1. Field of the Invention

The present invention relates generally to the field of pollution control devices. More specifically the present invention relates to a particle removal apparatus for placement in an internal combustion engine air intake line or exhaust line to remove particles from the gas by passing the gas along a spiral path between spaced apart oppositely charged first and second spiral plates, so that the particles become charged and collect on one of the plates and subsequently drop or are blown into disposal passageway such as for delivery into a particle storage sump. Additionally, the present invention reveals a method of ozonizing the air-intake of a combustion engine to improve the combustion properties of the a fuel. The first spiral plate preferably spirals around and longitudinally along and is secured to the exterior surface of an electrically conductive disposal passageway in the form of a disposal tube having a particle admitting longitudinal tube slot adjacent the series of plate spirals, and the second spiral plate preferably spirals within and longitudinally along and is secured to the interior surface of an electrically conductive outer mounting tube such as a containment housing tubular side wall, such that the second spiral plate spirals parallel to and spaced apart a selected and substantially uniform distance from the first spiral plate, and the disposal tube and attached first spiral plate are charged by connection to a first electric terminal pole and the outer mounting tube and the attached second spiral plate are charged by connection to a second electric terminal pole having a charge opposite that of the first electric terminal pole. The disposal tube is mounted on electrically insulating material to be electrically isolated from the remainder of the apparatus and therefore to sustain the independent charge applied to it and the attached first spiral plate. The outer mounting tube is also mounted on electrically insulating material to be electrically isolated from the remainder of the apparatus and therefore to sustain the independent charge applied to it and the attached second spiral plate. The disposal tube and containment housing preferably are coaxial.

The containment housing preferably has a housing first end wall, and the gas admission passageway opens directly into the housing first end wall. The containment housing further preferably has a housing second end tapering to a gas release opening spaced radially outward from the disposal tube so that exhaust gas can pass between the gas release opening and the disposal tube. The containment housing alternatively simply has a housing first end which opens into a fan shroud containing a fan for pulling gas into the containment housing.

2. Description of the Prior Art

There have long been electrostatic precipitators and other devices for removing pollutant particles from gases before they are released into the atmosphere. A problem has been that these devices are often expensive and inefficient. Gases and suspended particles have been passed between charged plates in some such devices, but removing the collected particles from the device can be time consuming, and since the gas can pass through a rectilinear path between the plates the momentum can cause some of the particles to remain within the flow rather than be diverted to a plate by the electric charge. In addition, there are advantages to using such devices to ionize air-intake in an engine to generate combustible ozone gas that has more oxygen content than otherwise. Finally, these devices can be bulky.

It is thus an object of the present invention to provide a particle removal apparatus in which charged plates are configured to a more compact shape while providing a non-rectilinear, spiral path for gas passage which causes suspended particles to be thrown against a charged surface partly by centrifugal forces.

It is another object of the present invention to provide such an apparatus in which the plates are themselves spiral shaped and which can assist gas delivery into the apparatus with a fan or blower.

It is still another object of the present invention to provide such an apparatus which can be mounted on diesel vehicles and motors for exhaust gas particle removal, potentially as a replacement to a diesel particulate filter (DPF), reducing back pressure associated with DPF s.

It is yet another object of the present invention to provide such an apparatus which can be readily mounted to fit within either an air intake line, such as for NASCAR™ race cars, which may not have air filters or an exhaust gas line of an internal combustion engine.

It is a further object of the present invention to provide such an apparatus in which air intake applications for gasoline, diesel and bio-diesel enhance combustion, and thus fuel efficiency, via the result of electrostatic charge and ionization, whereby O and O3 (and other species) are being isolated and introduced into the air intake prior to combustion.

It is a yet further object of the present invention to provide such an apparatus in which exhaust applications enhance the off-gas treatment of emissions via the result of electrostatic charge and ionization, whereby O and $O_3$ (and other species) are being isolated and introduced into the off-gases and into a—standard—catalyst for gasoline applications, and into a—standard—diesel oxidation catalyst (DOC) for diesel and bio-diesel applications.

This is a key object and feature as the intake application, either alone or in part, enhances combustion and thus fuel efficiency, as well as aiding in the reduction of off-gas emissions; while the exhaust application, either alone or in part, enhances the off-gas treatment of emissions (specifically NOx) after the isolation and removal of the particulate matter.

It is finally an object of the present invention to provide such an apparatus which is compact, easy to install, sturdy, reliable and inexpensive to manufacture.

SUMMARY OF THE INVENTION

The present invention accomplishes the above-stated objectives, as well as others, as may be determined by a fair reading and interpretation of the entire specification.

A particle removal apparatus is provided for connection to an internal combustion engine air intake line or exhaust line to remove particles from flowing gas, including an electrically conductive first spiral plate which spirals around at a certain pitch and longitudinally along and is secured to the exterior surface of the electrically conductive disposal tube having a particle admitting tube opening; and an electrically conductive second spiral plate which spirals around at the same said pitch within and longitudinally along and is secured to the interior surface of the an electrically conductive outer mounting tube, the second spiral plate spiraling parallel to and spaced apart a selected and distance from the first spiral plate; so that the particles become charged and collect on one of the plates and subsequently enter the disposal tube.

The outer mounting tube preferably is a tubular side wall of a containment housing. The first spiral plate and the second spiral plate are spaced from each other a substantially uniform distance. The disposal tube and the attached first spiral plate preferably are charged by connection to a first electric terminal pole, and the outer mounting tube and the attached the second spiral plate are charged by connection to a second electric terminal pole having a charge opposite that of the first electric terminal pole. The disposal tube preferably is mounted on electrically insulating material to be electrically isolated from the remainder of the apparatus and therefore to sustain the independent charge applied to it and the attached first spiral plate, and the outer mounting tube is also mounted on electrically insulating material to be electrically isolated from the remainder of the apparatus and therefore to sustain the independent charge applied to it and the attached second spiral plate. The disposal tube and containment housing preferably are coaxial.

The containment housing preferably has a housing first end wall, and the gas admission passageway opens directly into the housing first end wall; and the containment housing preferably has a housing second end tapering to a gas release opening spaced radially outward from the disposal tube, so that exhaust gas can pass between the gas release opening the disposal tube.

The apparatus preferably additionally includes a fan contained within a fan shroud for pulling gas into the containment housing; and the containment housing has a housing first end which opens into the fan shroud. The fan preferably has radial fan blades extending from a fan hub rotatably mounted around the disposal tube and driven by a drive mechanism. The fan shroud preferably includes a tubular shroud side wall having a radial gas admission passageway and first and second shroud end walls. The disposal tube preferably has a radially extending particle exit tube, where particles removed by the plates are driven by gas pressure and flow through the particle exit tube.

The disposal tube preferably has a disposal tube first end which is rotatably mounted within a tube bearing mounted in the first shroud end wall, through which a disposal tube first end rotatably passes, and the disposal tube has a disposal tube closed second end from which a solid axle segment axially extends into an axle segment bearing; so that the disposal tube and the attached first spiral plate are rotatable axially relative to the containment housing and the attached second spiral plate, so that the first spiral plate advances one of toward and away from the second spiral plate as a result of the pitch of the first spiral plate, depending on the direction of disposal tube rotation. The disposal tube optionally has a longitudinally advancing exterior thread and the first spiral plate is mounted to and extends radially outward from an internally threaded carriage tube; so that the disposal tube acts as a drive screw and rotation of the disposal tube relative to the carriage tube advances the carriage tube and the attached first spiral plate one of toward and away from the second spiral plate, depending on the direction of disposal tube rotation.

The apparatus preferably additionally includes an apparatus mounting plate fastened to the shroud having fastener ports so that the mounting plate can be bolted to an apparatus mounting structure.

A particle removal apparatus is further provided for connection to an internal combustion engine air intake line or exhaust line to remove particles from flowing gas, the apparatus including an electrically conductive first spiral plate having a charge; and an electrically conductive second spiral plate which spirals within and longitudinally along the interior surface of a containment housing, the second spiral plate having a charge opposite that of the first spiral plate and spiraling parallel to and spaced apart a selected distance from the first spiral plate; so that the particles become charged and collect on one of the plates for recovery and disposal of the particles.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
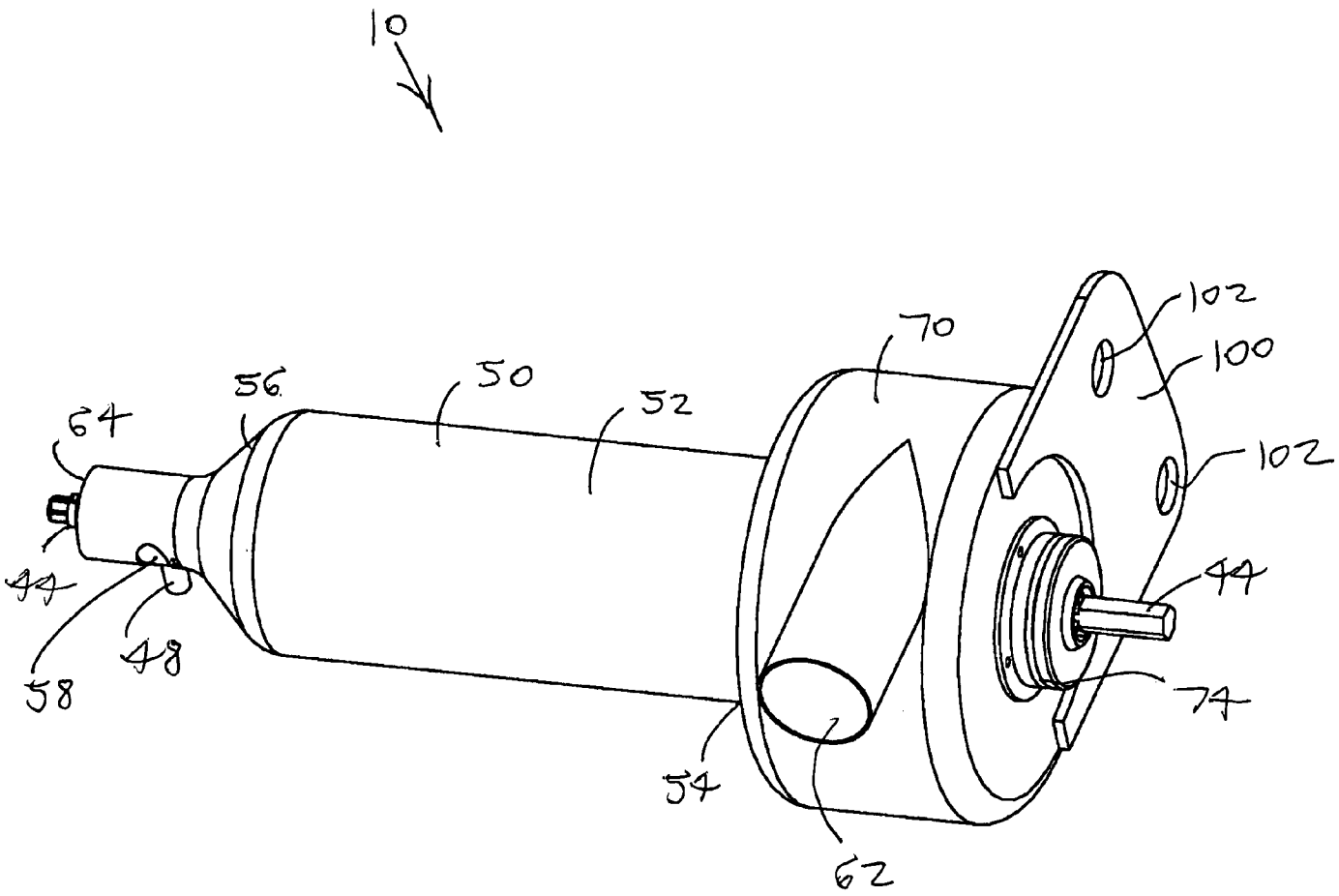
FIG. 1 is a side perspective view of the apparatus showing the gas admission passageway and apparatus mounting plate.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various Figures are designated by the same reference numerals.

First Preferred Embodiment

Figure 2:
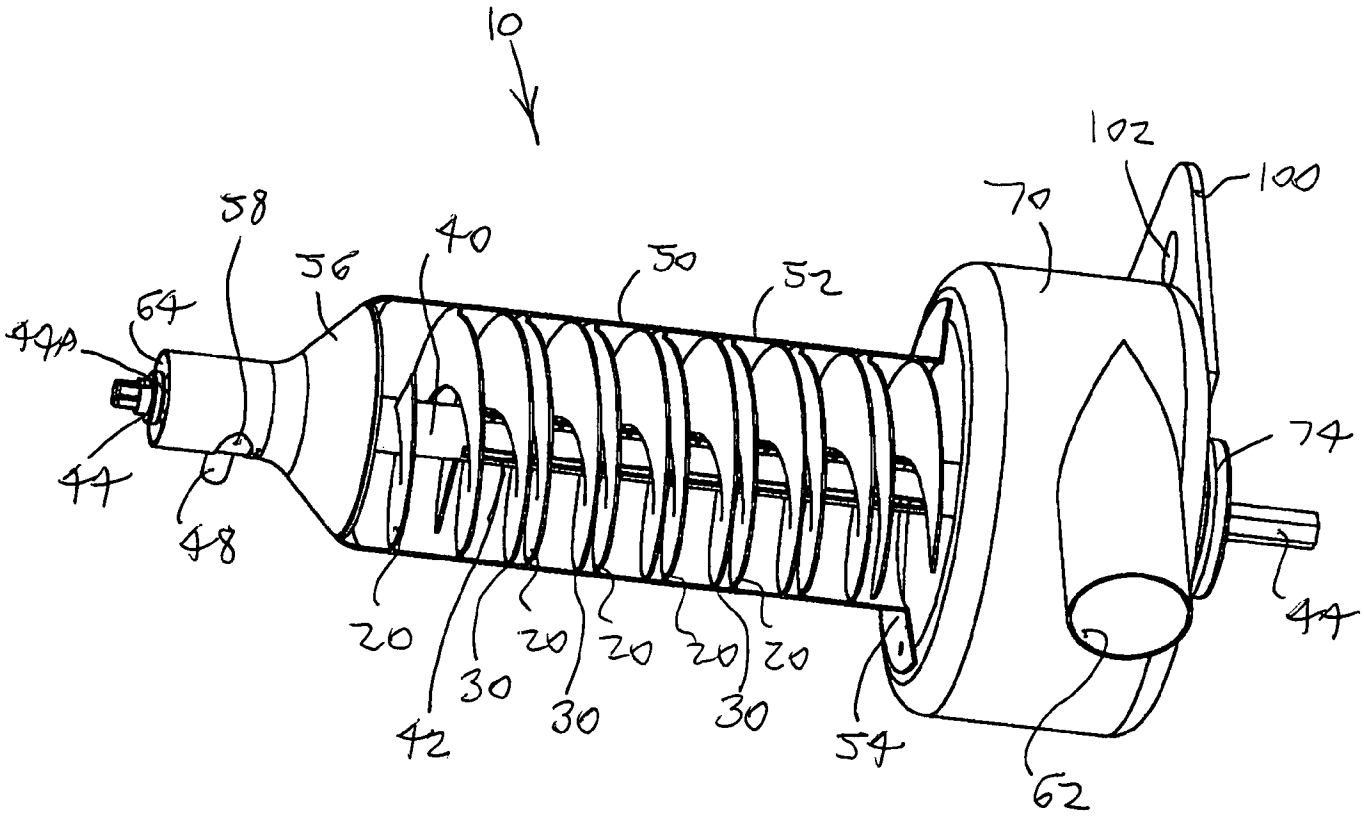
FIG. 2 is a side perspective view of the apparatus with a portion of the housing tubular side wall broken away to reveal the first and second spiral plates.
Figure 3:
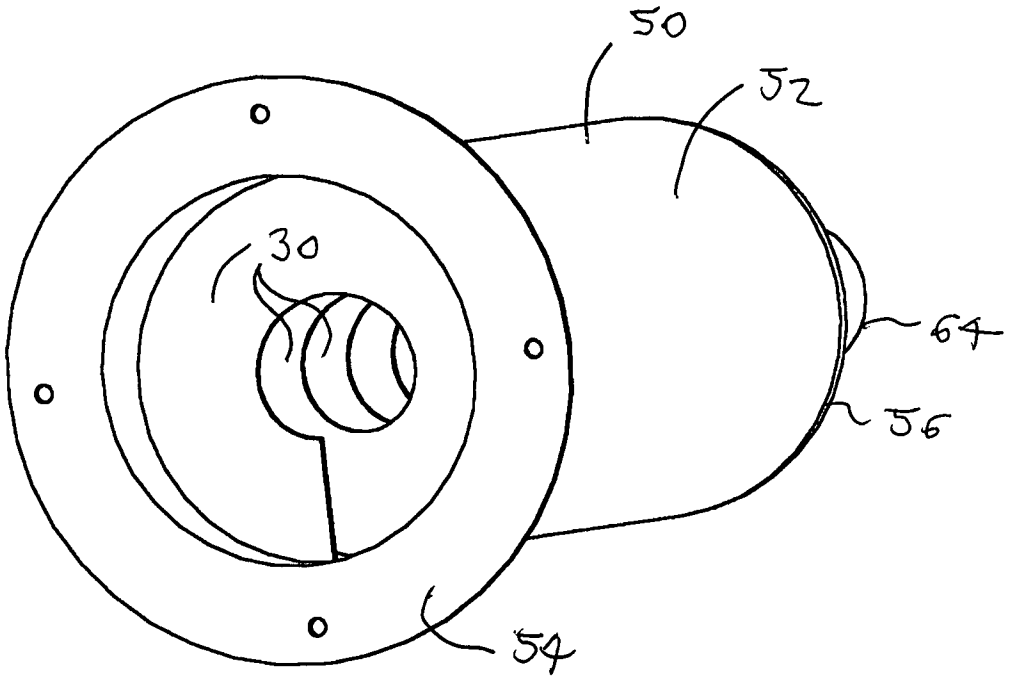
FIG. 3 is an end perspective view of the containment housing and of the internally projecting second spiral plate.
Figure 4:
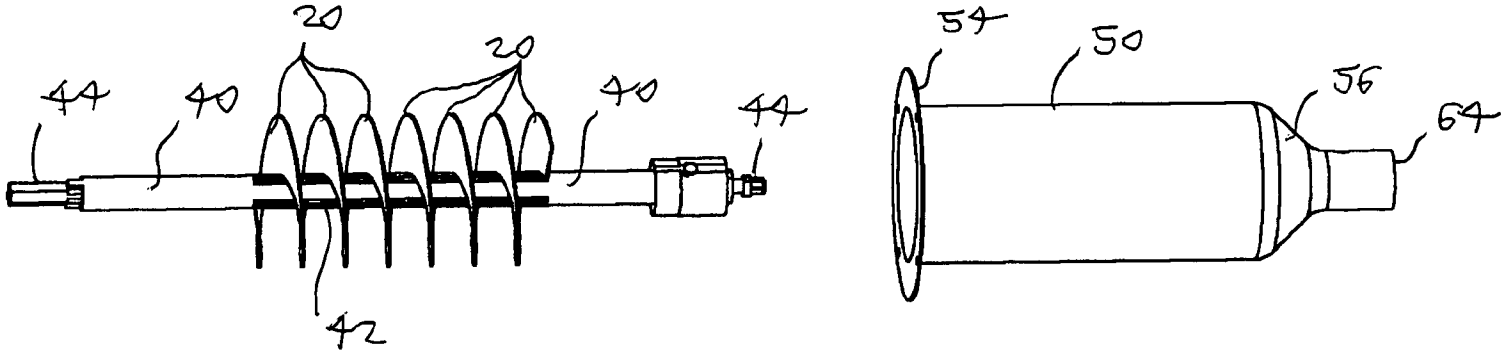
FIG. 4 is an exploded side view of the apparatus showing the disposal tube and outwardly projecting first spiral plate spaced axially outward from the containment housing.
Figure 5:
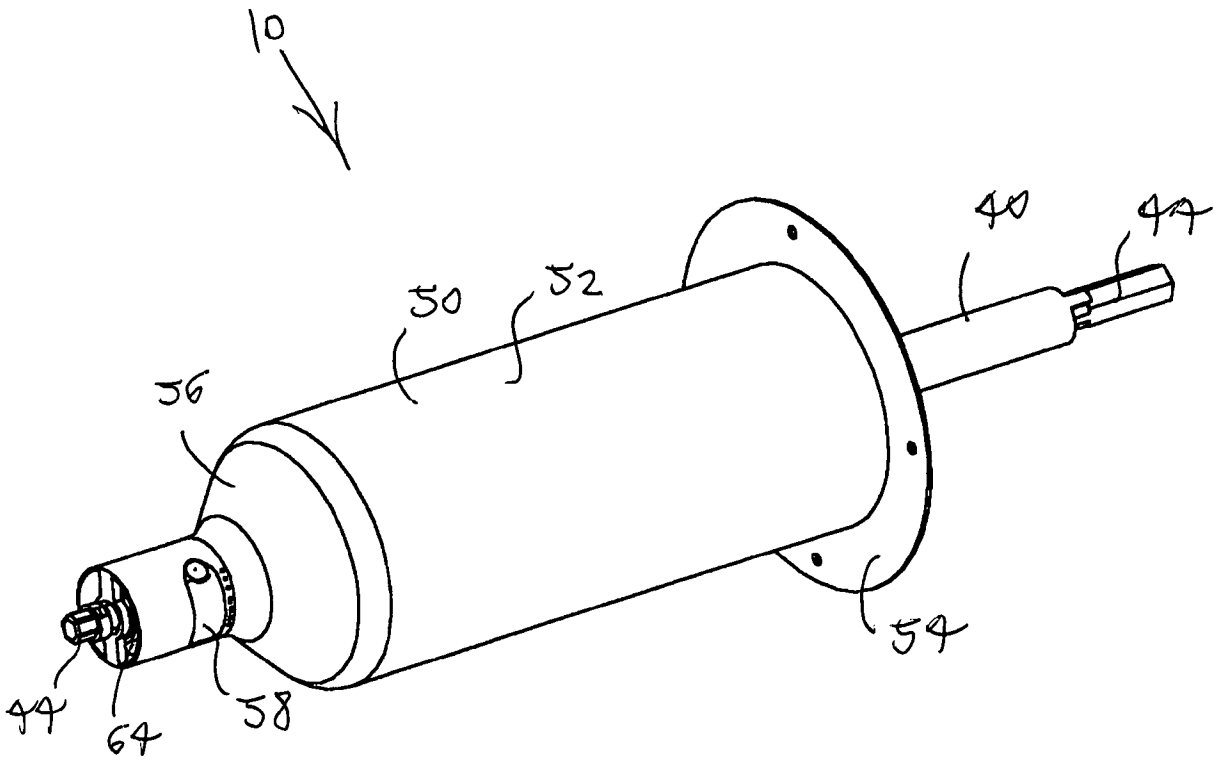
FIG. 5 is a perspective view of the containment housing, showing the gas release opening containing an end of the solid axle segment.
Figure 6:
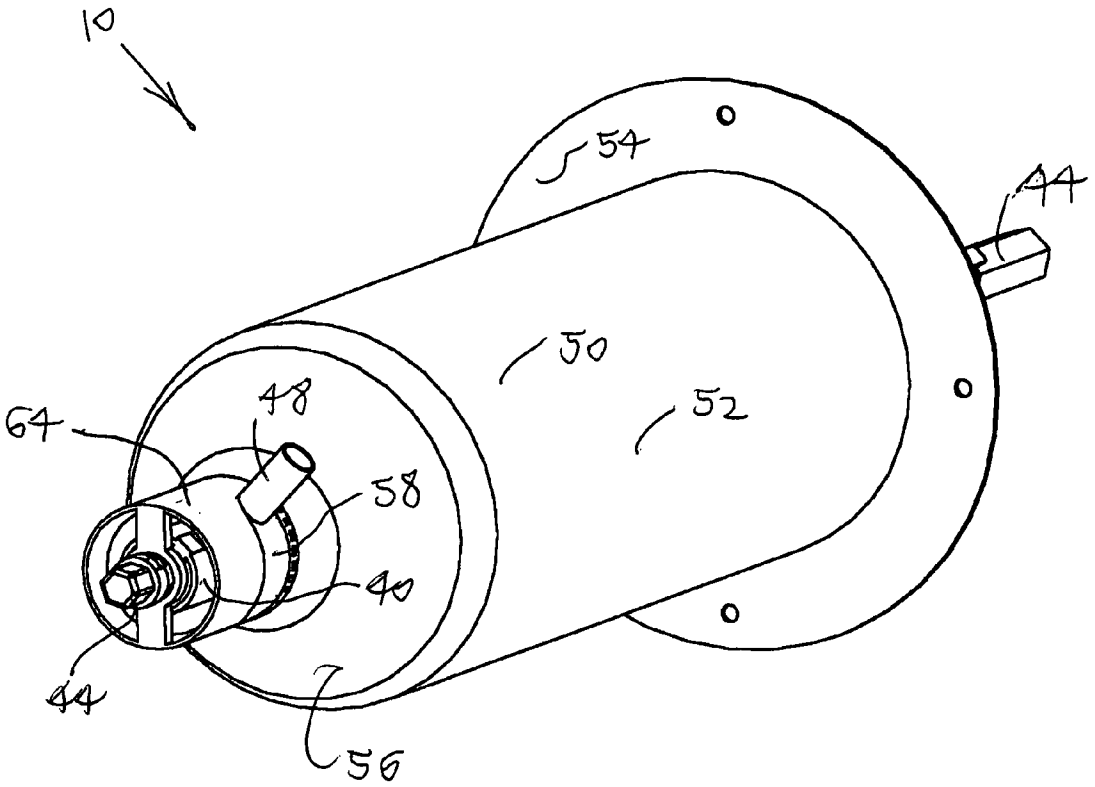
FIG. 6 is an end perspective view as in FIG. 5, showing the circumferential tube slot and radially extending particle exit tube in the slot.
Figure 7:
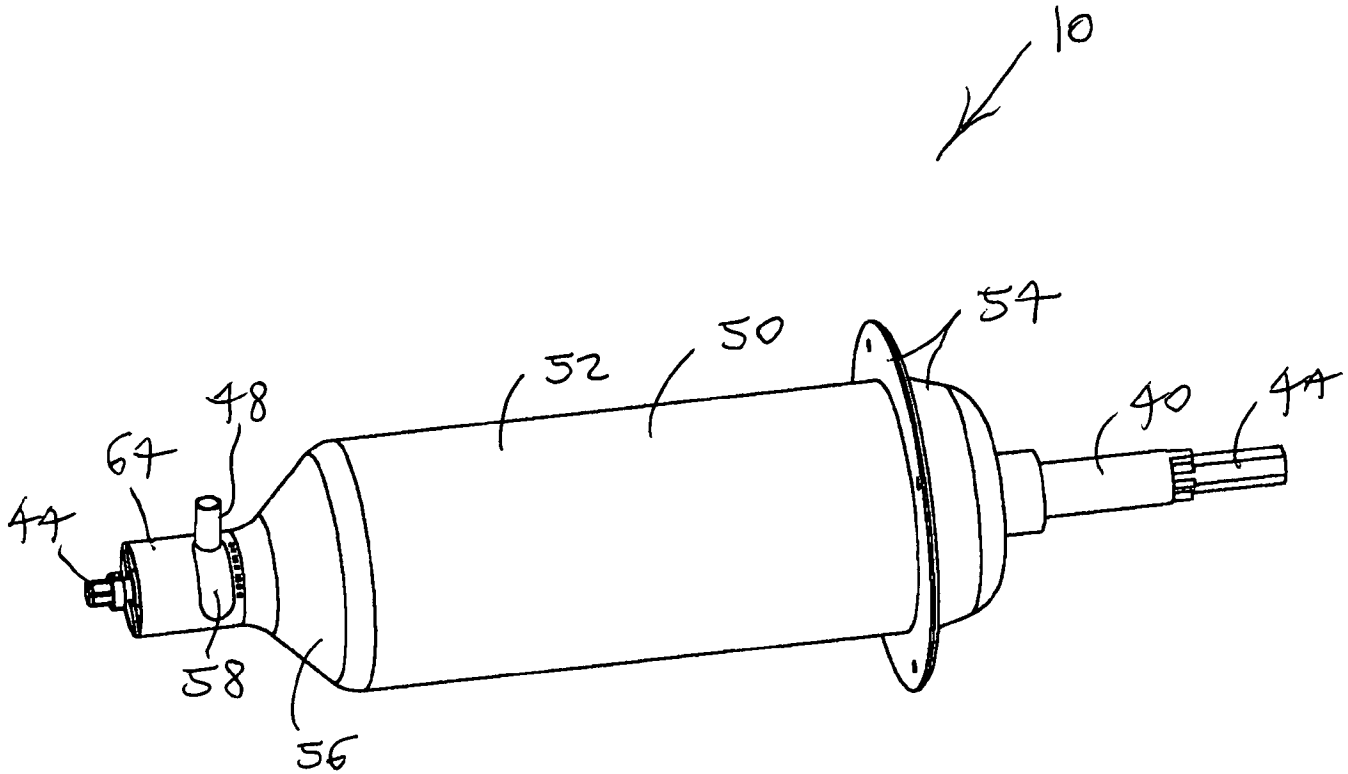
FIG. 7 is side perspective view of the apparatus.
Figure 8:
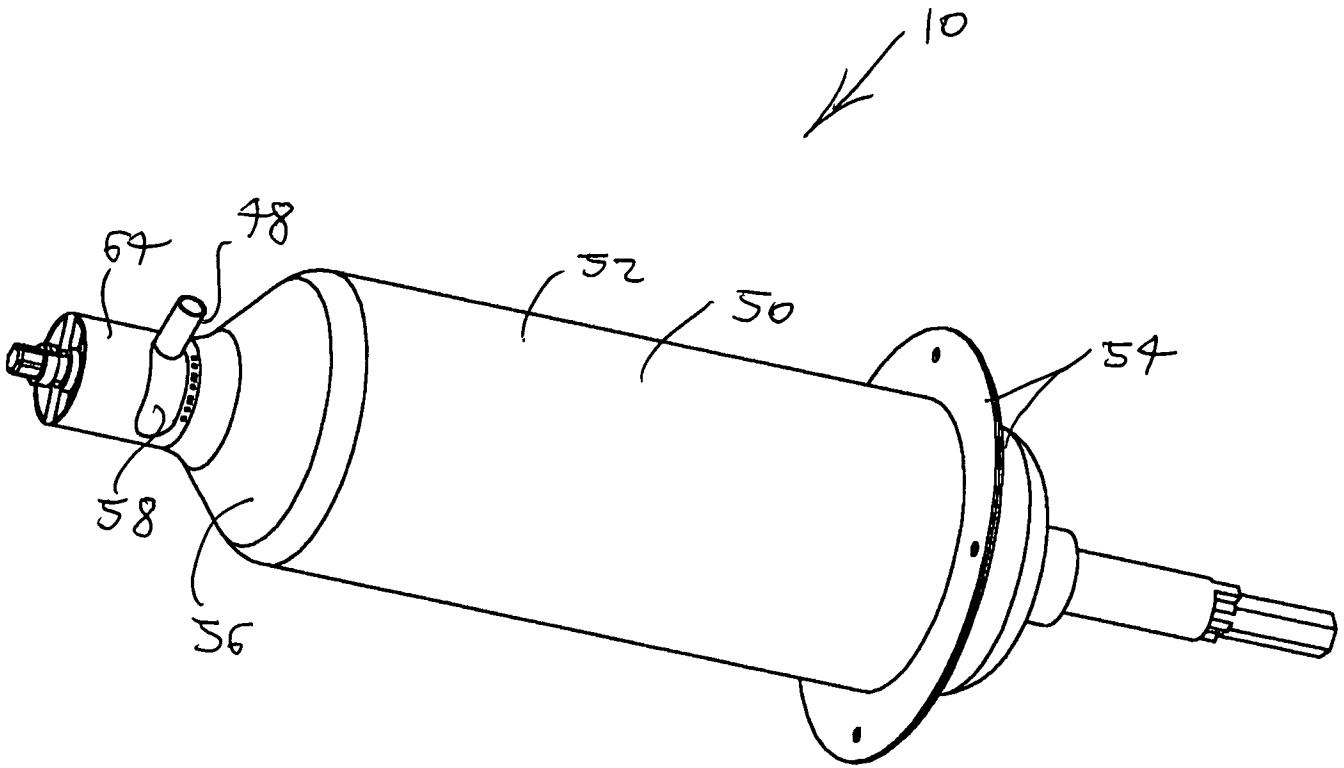
FIG. 8 is another side perspective view of the apparatus.
Figure 9:
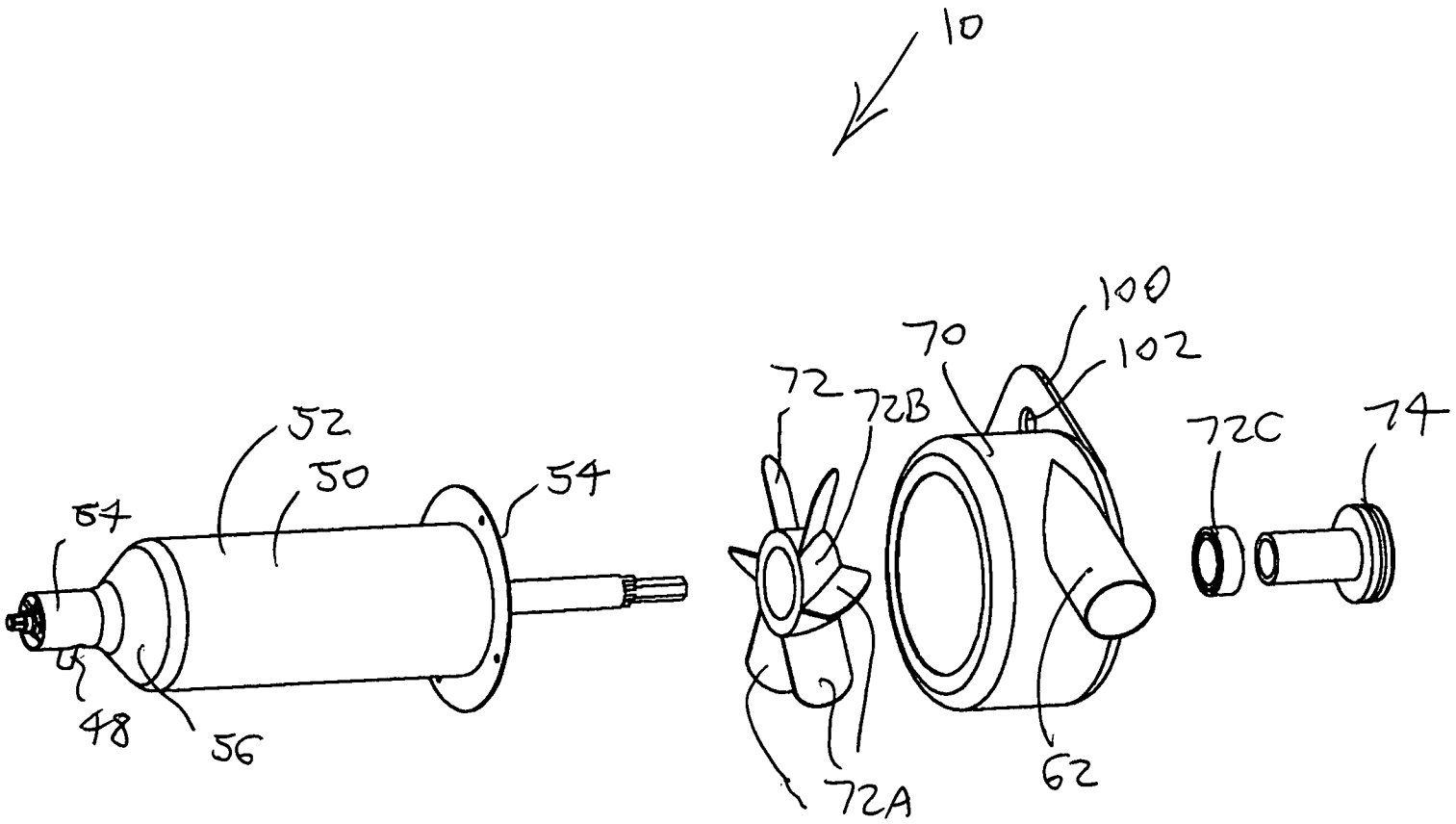
FIG. 9 is an exploded side perspective view of the apparatus, showing the fan, fan housing and pulley.
Figure 10:
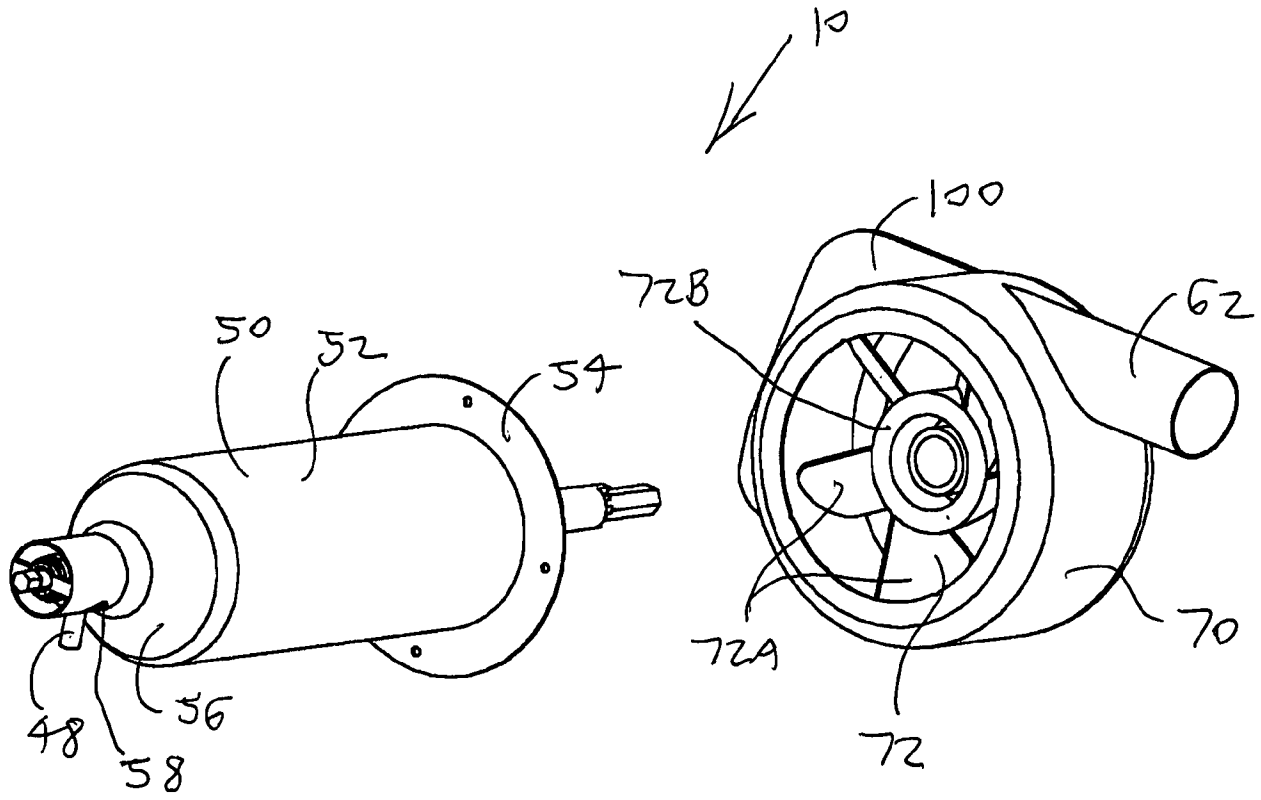
FIG. 10 is an end perspective view of the apparatus with the fan and fan housing separated in exploded relation.
Figure 11:
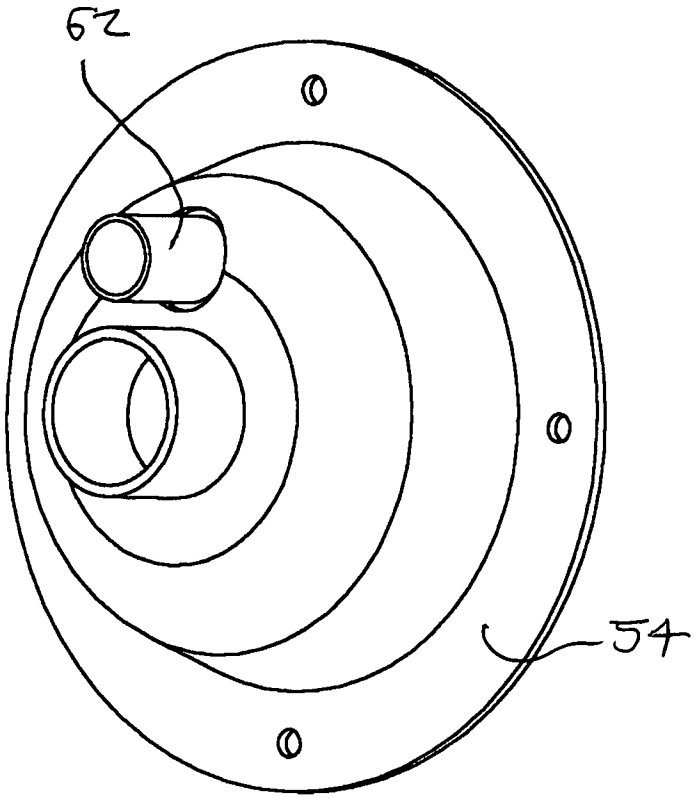
FIG. 11 is a perspective view of the housing end plate.
Figure 12:
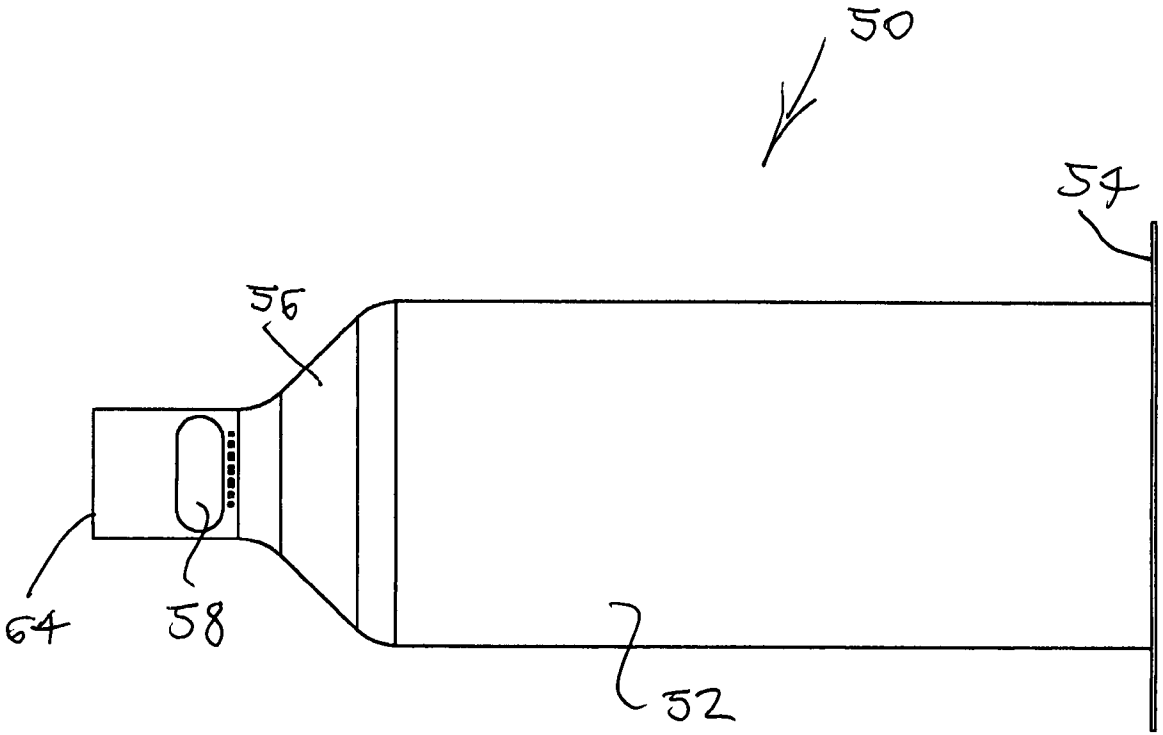
FIG. 12 is a plan side view of the housing with no end plate or fan shroud.
Figure 13:
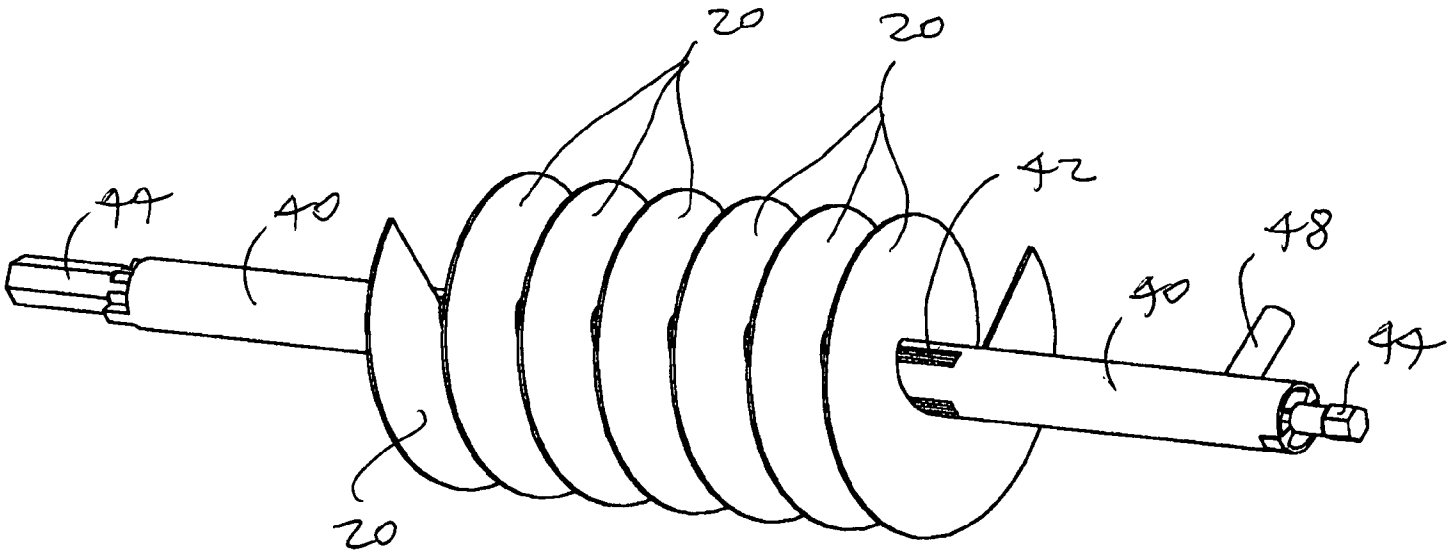
FIG. 13 is a perspective view of the disposal tube and outwardly protruding first spiral plate.
Figure 14:
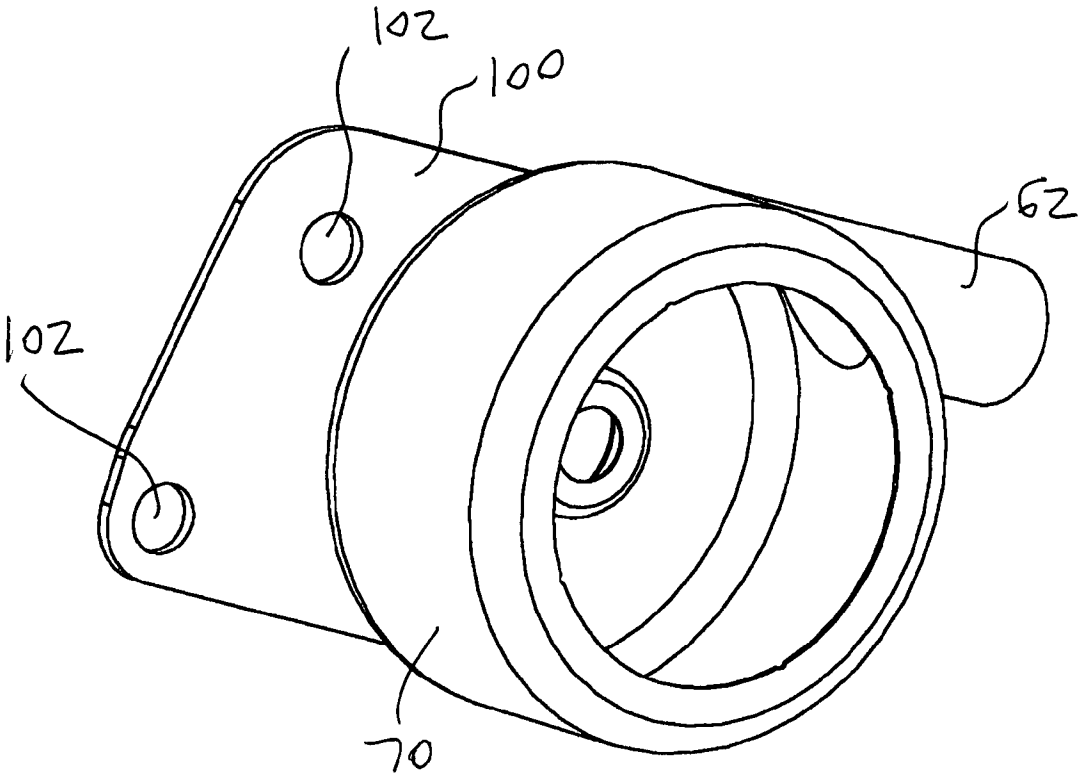
FIG. 14 is a perspective view of the fan shroud.
Figure 15:
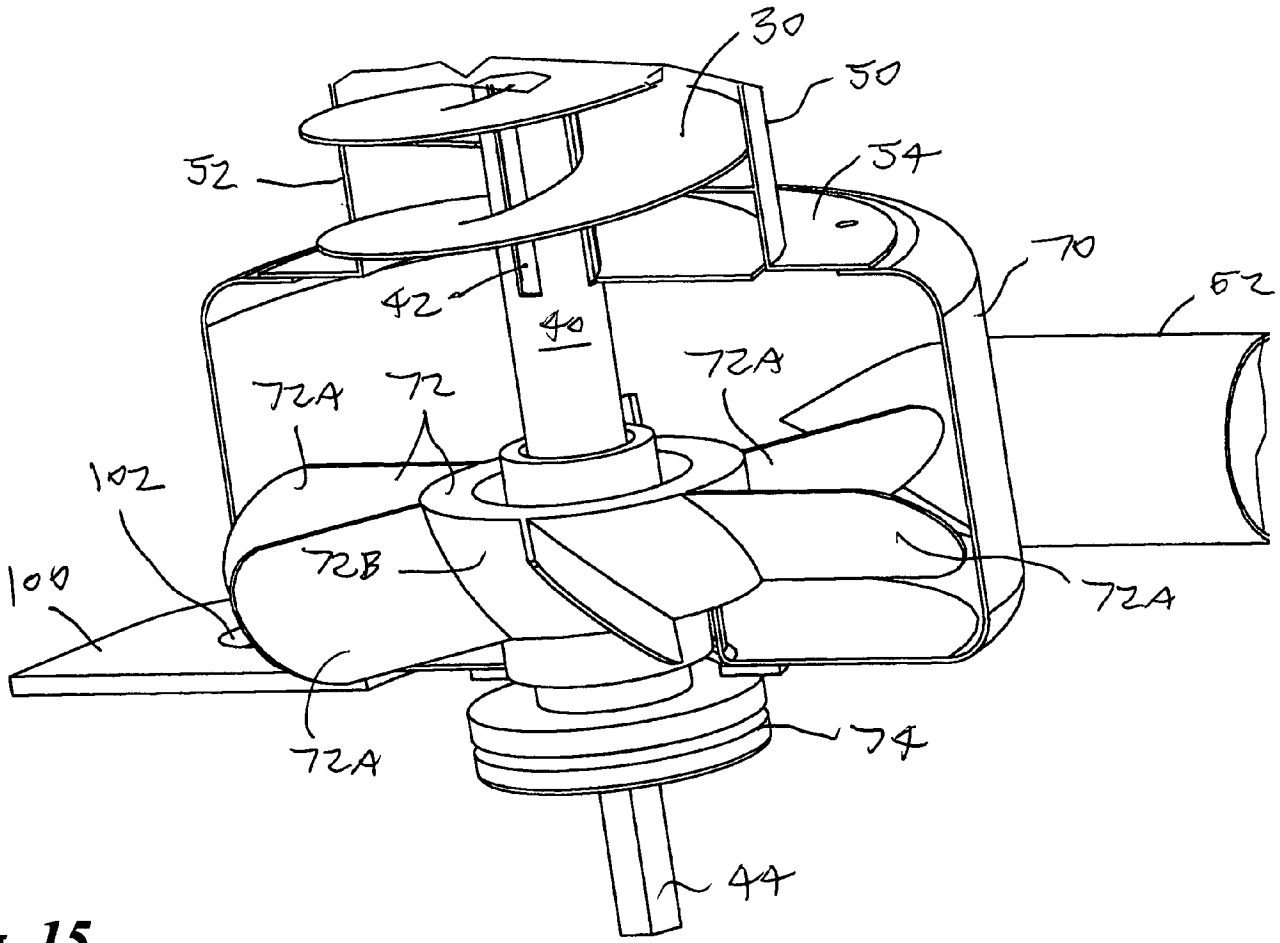
FIG. 15 is a perspective view of the fan assembly with a portion of the fan shroud broken away to reveal the fan, and also showing the belt pulley.
Figure 16:
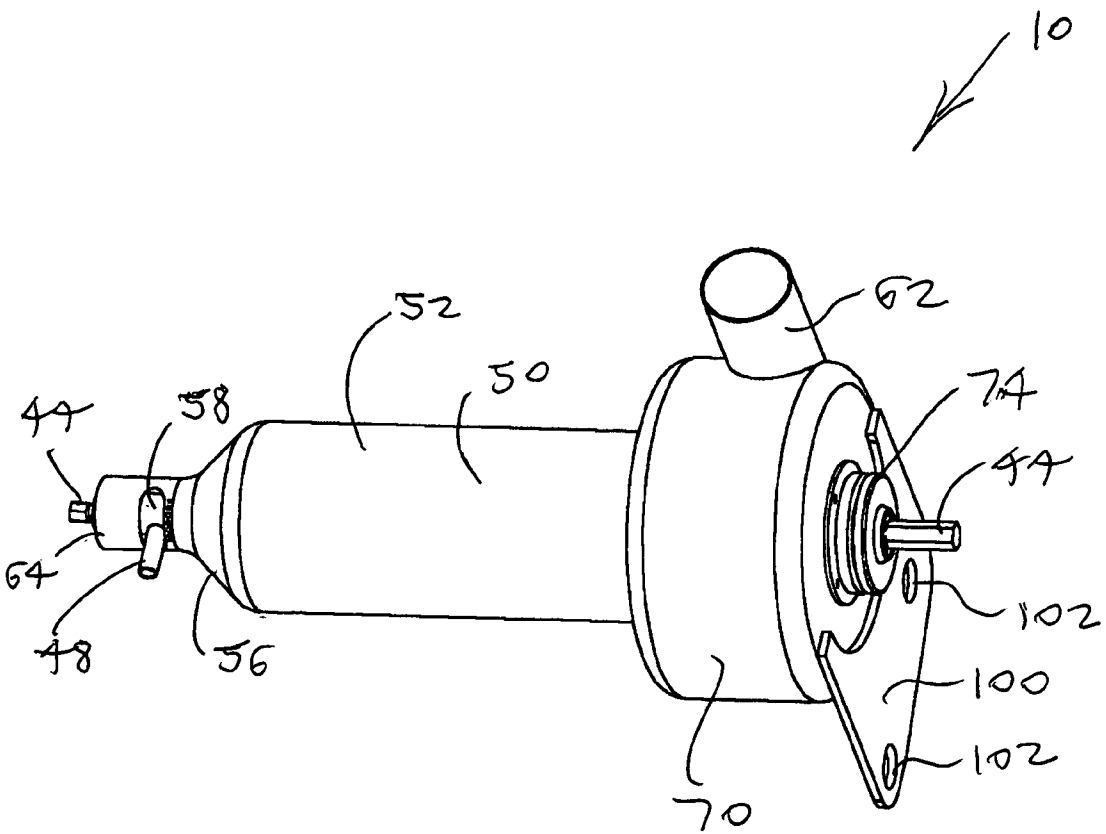
FIG. 16 is a side perspective view of the apparatus.
Figure 17:
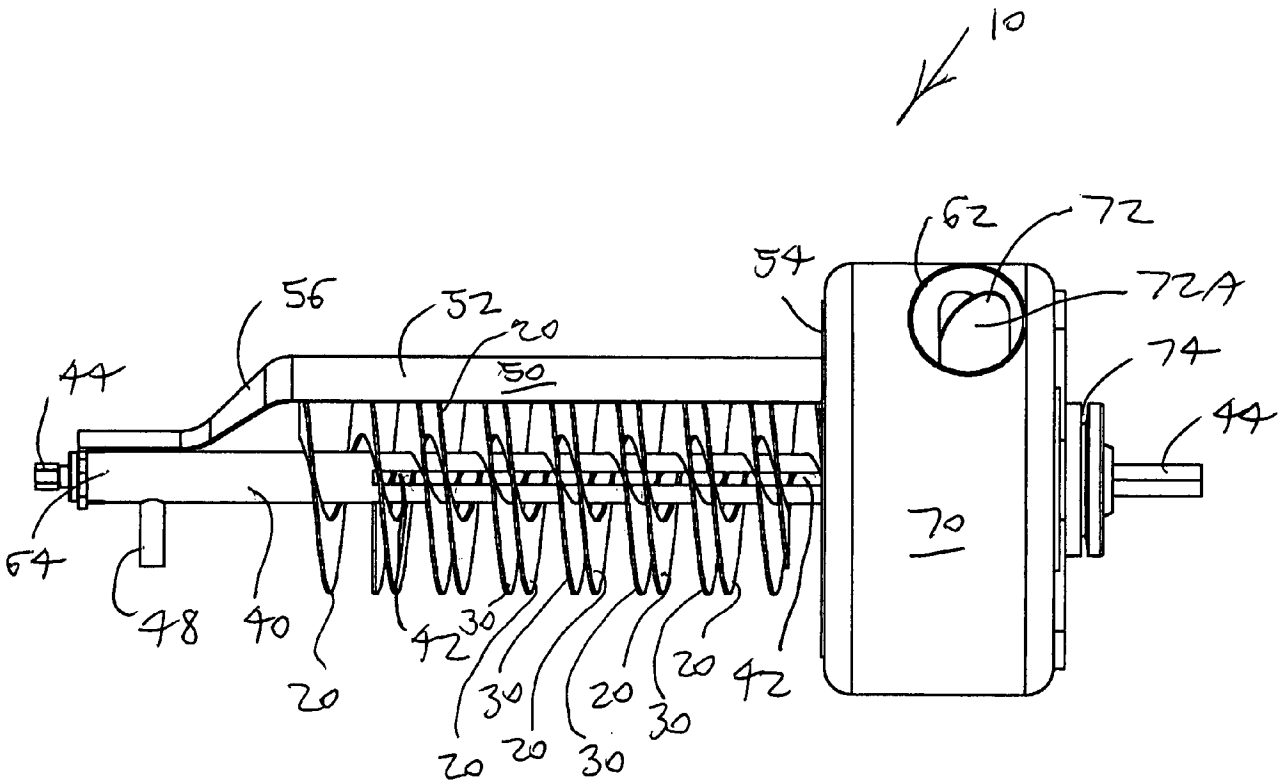
FIG. 17 is a plan side view of the apparatus with a portion of the containment housing broken away.
Figure 18:
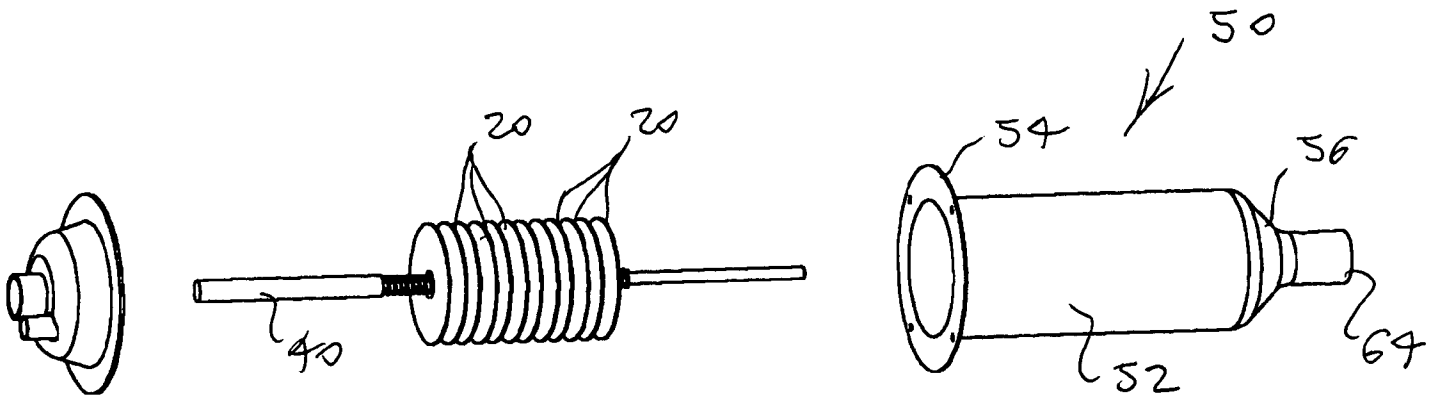
FIG. 18 is an exploded view of the apparatus having no fan or fan shroud, showing the apparatus end plate, disposal tube and containment housing in axially spaced relation.
Figure 19:
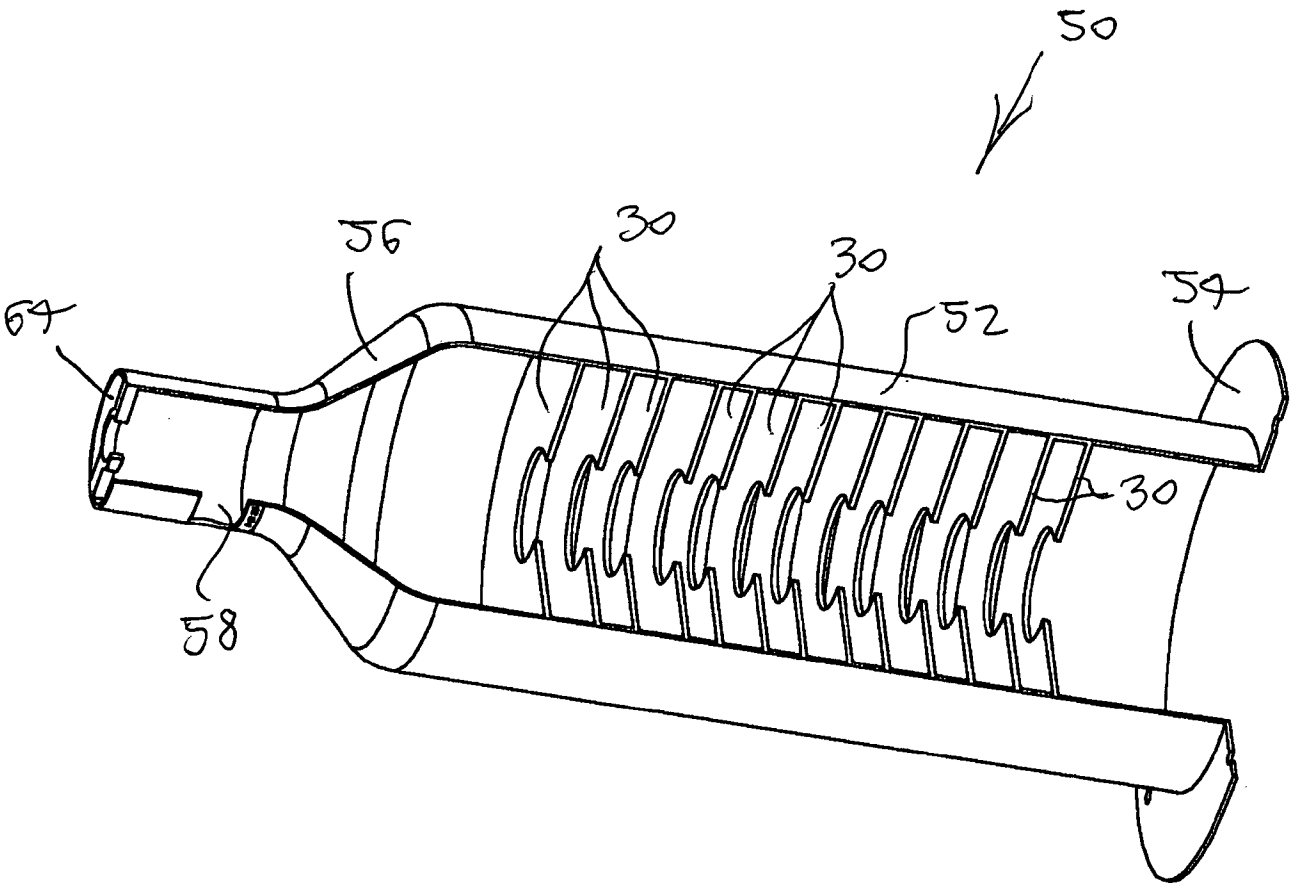
FIG. 19 is a partly broken away side perspective view of the containment housing having inwardly protruding parallel plates.
Figure 20:
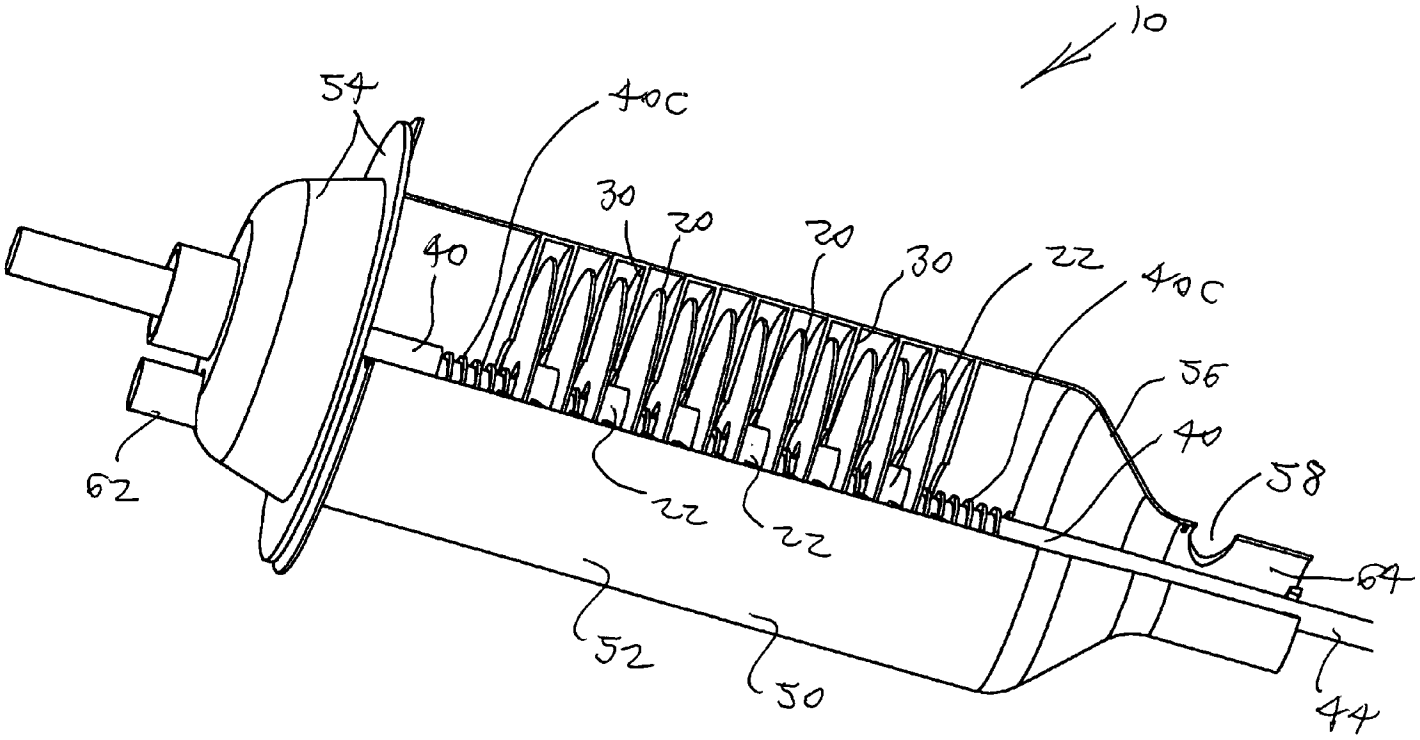
FIG. 20 is a perspective side view of the apparatus with a portion of the containment housing broken away to reveal the first and second spiral plates and the disposal tube exterior thread.
Figure 21:
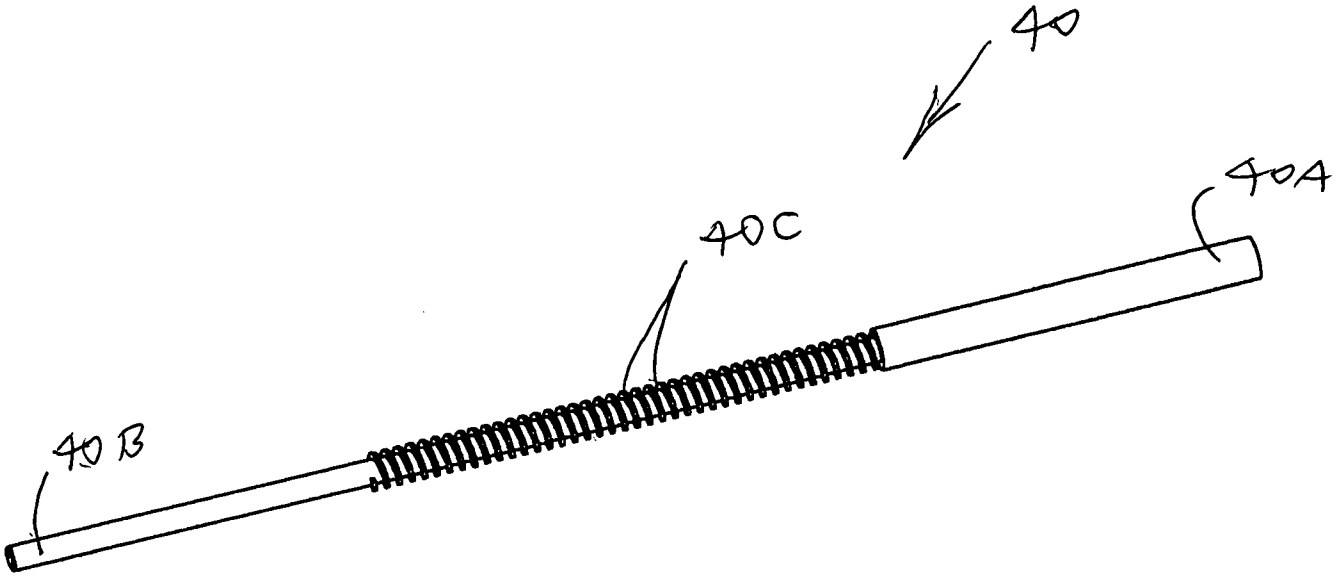
FIG. 21 is a perspective side view of the disposal tube, showing the disposal tube exterior thread.
Figure 22:
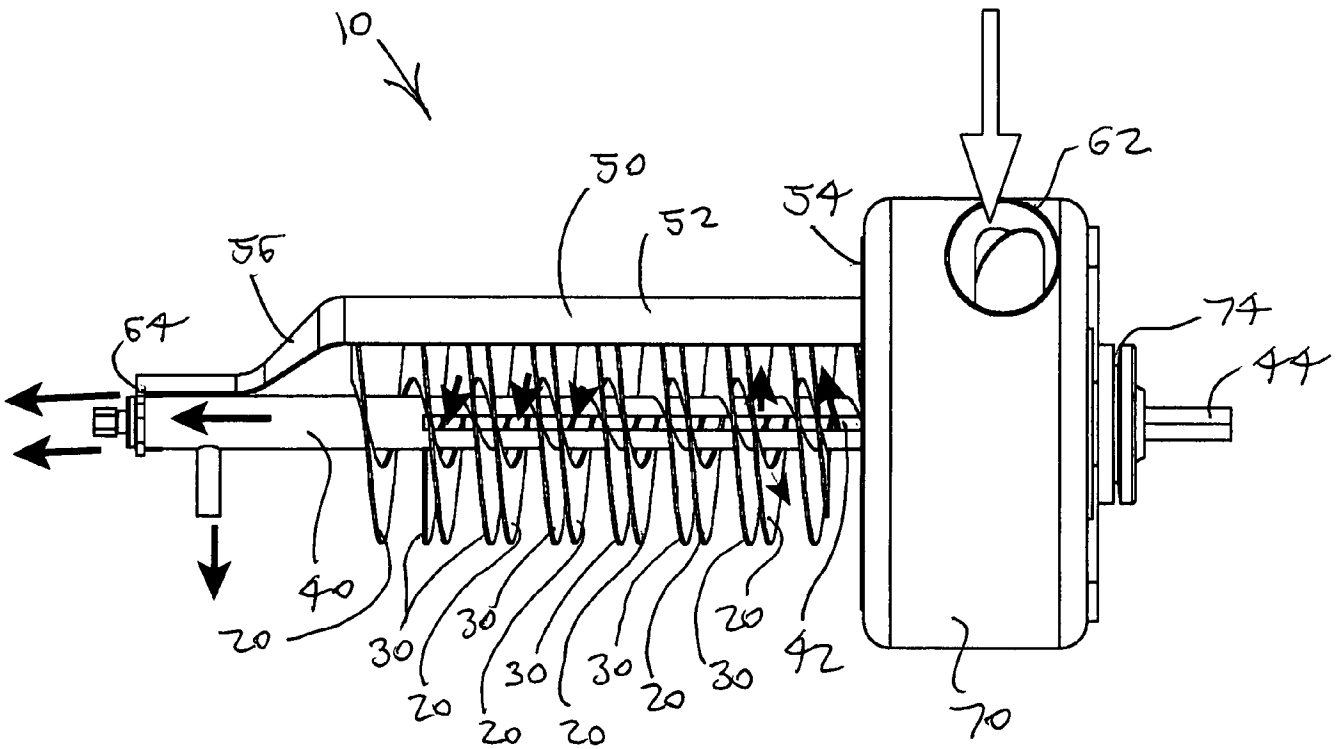
FIG. 22 is a plan side view of the apparatus with a portion of the containment housing broken away, and showing with arrows the gas intake and release openings.
Figure 23:
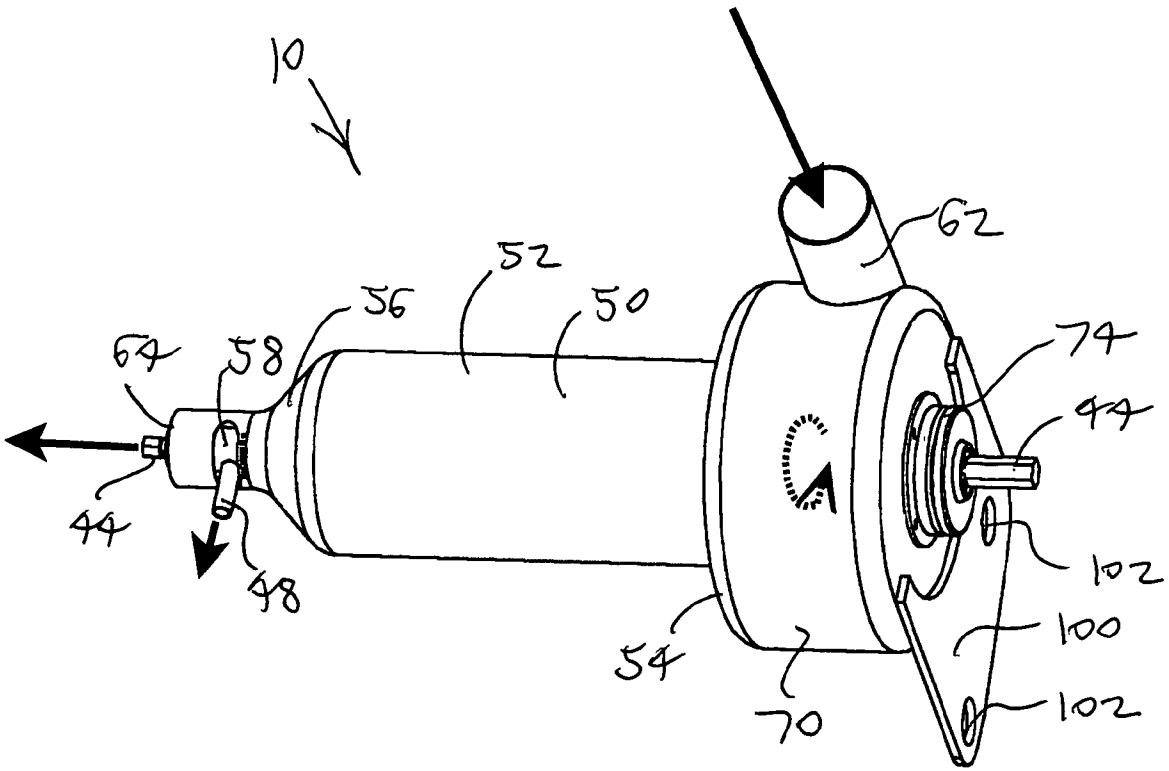
FIG. 23 is a side perspective view of the apparatus, again showing with arrows the gas intake and release openings.
Figure 24:
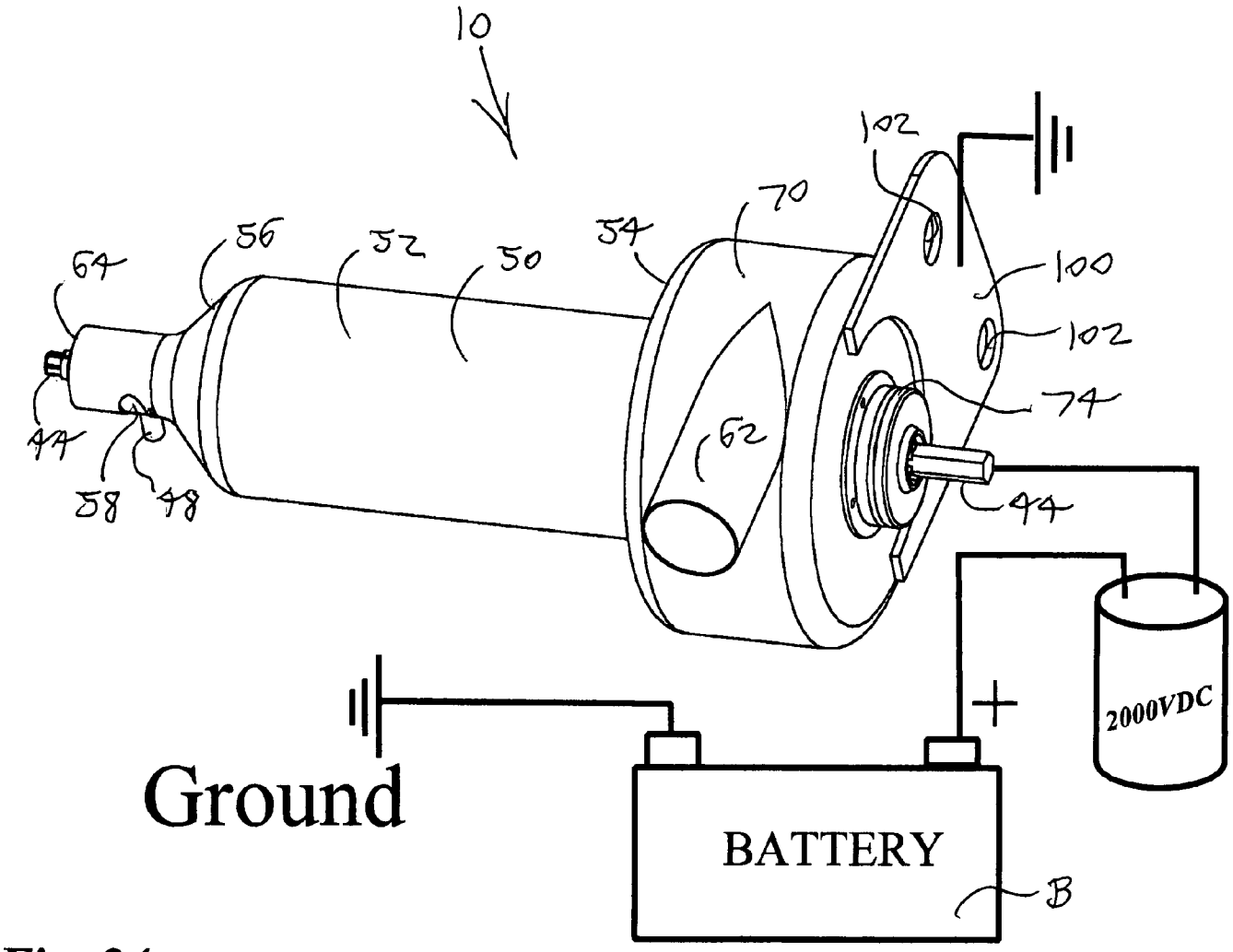
FIG. 24 is a perspective view of the apparatus also showing the battery and ground.
Figure 25:
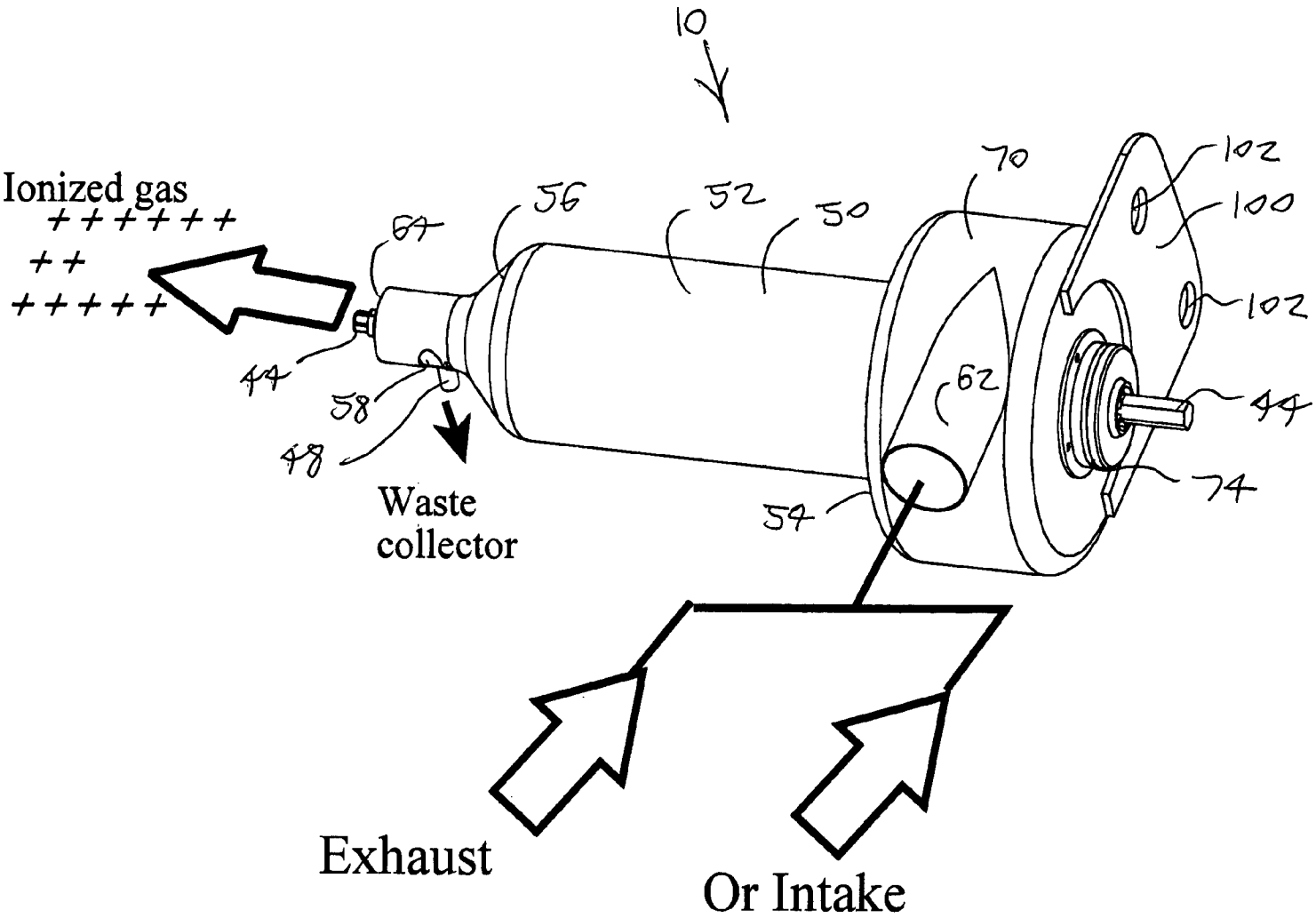
FIG. 25 is a perspective view of the apparatus showing with gas and waste flow with arrows.

Referring to FIGS. 1-25, a particle removal apparatus 10 is disclosed for placement in an internal combustion engine air intake line or in an exhaust line to remove particles from the flowing gas by passing the gas, whether exhaust gas or air, along a spiral path between spaced apart oppositely charged first and second spiral plates 20 and 30, respectively, so that the particles become charged and collect on one of the plates 20 or 30. Centrifugal air flow around and between the spiral plates 20 and 30 cause charged particulate to be electrostatically captured on plates 20 and 30 to flow radially inward, and subsequently drop or are blown into a disposal passageway such as for delivery into a particle storage sump (not shown).

The first spiral plate 20 preferably spirals around and longitudinally along and is secured to the exterior surface of an electrically conductive disposal passageway in the form of a disposal tube 40 having a particle admitting longitudinal tube slot 42 adjacent the series of plate spiral segments, and the second spiral plate 30 preferably spirals within and longitudinally along and is secured to the interior surface of an electrically conductive outer mounting tube such as a housing tubular side wall 52 of a containment housing 50, such that the second spiral plate 30 spirals parallel to and spaced apart a selected and substantially uniform distance from the first spiral plate 20, and the disposal tube 40 and attached first spiral plate 20 are charged by connection to a first electric terminal pole (not shown) and the outer mounting tube 52 and the attached second spiral plate 30 are charged by connection to a second electric terminal pole (not shown) having a charge opposite that of the first electric terminal pole. The disposal tube 40 is mounted on electrically insulating material (not shown) to be electrically isolated from the remainder of the apparatus 10 and therefore to sustain the independent charge applied to it and the attached first spiral plate 20. The outer mounting tube 52 is also mounted on electrically insulating material (not shown), once again to be electrically isolated from the remainder of the apparatus 10 and therefore to sustain the independent charge applied to it and the attached second spiral plate 30. The disposal tube 40 and containment housing 50 preferably are coaxial.

The containment housing 50 preferably has a housing first end wall 54, and a gas admission passageway 62 opens directly into the housing first end wall 54. The containment housing 50 further preferably has a housing second end 56 tapering to a gas release opening 64 spaced radially outward from the disposal tube 40 so that exhaust gas can pass between the gas release opening 64 and the disposal tube 40.

The containment housing 50 alternatively simply has a housing first end 54 which opens into a fan shroud 70 containing a fan 72 for pulling gas through the shroud 70 into the containment housing 50. The fan 72 has radial fan blades 72A extending from a fan hub 72B rotatably mounted around the disposal tube 40 on a bearing 72C and driven by a belt (not shown) fitted around a belt pulley 74 secured to an end of the fan hub 72B protruding outside the fan shroud 70. The fan shroud 70 has a tubular shroud side wall having a radial gas admission passageway 62 and first and second shroud end walls.

The disposal tube 40 preferably has a radially extending particle exit tube 48 which preferably leads to the particle storage sump. Particles removed by the plates 20 and 30 are driven by gas pressure and flow through the particle exit tube 48 into the particle storage sump.

The disposal tube 40 preferably has a disposal tube first end 40A which is rotatably mounted within a tube bearing 42 mounted in the first shroud 70 end wall, through which the disposal tube first end 40A rotatably passes. The disposal tube preferably has a disposal tube closed second end 40B from which a solid axle segment 44 axially extends. The axle segment 44 rotatably extends into an axle segment bearing 44A. Thus the disposal tube 40 and attached first spiral plate 20 are rotatable axially relative to the containment housing 50 and attached second spiral plate 30, so that the first spiral plate 20 either advances toward or away from the second spiral plate 30 as a result of the pitch of the first spiral plate 20, depending on the direction of disposal tube 40 rotation.

Alternatively, the disposal tube 40 has a longitudinally advancing exterior thread 40C and the first spiral plate 20 is mounted to and extends radially outward from an internally threaded carriage tube 22. A circumferential exit tube slot 58 preferably is provided in the containment housing to permit the disposal tube 40 to rotate a certain number of degrees relative to the containment housing 50. As a result, the disposal tube 40 acts as a drive screw and rotation of the disposal tube 40 relative to the carriage tube 22 advances the carriage tube 22 and the attached first spiral plate 20 either toward or away from the second spiral plate 30, depending on the direction of disposal tube 40 rotation.

An apparatus mounting plate 100 preferably is fastened to the first shroud 70 end wall and has fastener ports 102 so that it can be bolted to a vehicle frame or other structure adjacent to the air intake or exhaust line.

Apparatus 10 can be mounted on diesel vehicles and motors for exhaust gas particle removal, potentially as a replacement to a diesel particulate filter (DPF), reducing back pressure associated with DPF s. In both intake and exhaust applications, apparatus 10 enhances combustion and off-gas treatment of emissions in a standard diesel oxidation catalyst (DOC) via the result of electrostatic charge and ionization, whereby O and $O_3$ (and other species) are being isolated and introduced into (a) the air intake, or (b) the off-gases. This is a key object and feature of apparatus 10, since the intake application, either alone or in part, reduces off-gas emissions (specifically $NO_x$) after the isolation and removal of the particulate matter (PM).

Advantageously, the particulate matter that is captured on spiral plates 20 may be removed by reversal of the polarity of the current to said spiral plate 20 and spiral plate 30. This causes particulate matter that was captured to be repulsed by the plates and thus removed from the plates.

Further, by bringing the space between the spiral plate 20 and spiral plate 30, the air flow rate can be substantially increased to push particulate matter (PM) from and clean said spiral plate 20 and spiral plate 30.

The electric charge is substantially achieved by use of a regular battery B, with step up transformer (not shown) to increase the battery B voltage by a substantial amount. Depending on the gap between the spiral plate 20 and spiral plate 30, the air flow rate can be substantially increased or decreased and the voltage can be proportionally increased or decreased with respect to the inverse square law for electrostatic attraction.

Further, since the gap between spiral plate 20 and spiral plate 30, depends on inward adjacent faces of the spirals, the opposite outward faces of the spirals will have an inversely proportional gap to the gap between the inward adjacent faces.

Advantageously, the said gaps can be maximized or minimized depending on the direction in which spiral plate 20 is rotated relative to the fixed spiral plate 30. Thus, both faces of each spiral can be cleaned by modification of the gap between the spirals such that the electrostatic charge between them will increase in one direction while proportionately decreased in the other direction.

Spiral plate 20 and spiral plate 30 are preferably made from electrically conduction metals such as aluminum or steel, however, high temperature conduction plastics impregnated with metallic particles may be used.

In yet another embodiment of the present invention, the charge imparted on spiral plate 20 and spiral plate 30, could be alternated with specific periods, to maximize the capture of particulate matter on both plates. This advantageously captures and releases the particulate matter and causes the centrifugal forces on said particulate matter to reduce substantially and thus allow them to spiral inward to disposal tube 40.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A particle removal apparatus for connection to an internal combustion engine air intake line or exhaust line to remove particles from flowing gas, comprising:

an electrically conductive first spiral plate which spirals around and longitudinally along and is secured to the exterior surface of an electrically conductive disposal tube having a particle admitting tube opening;

and an electrically conductive second spiral plate which spirals within and longitudinally along and is secured to the interior surface of an electrically conductive outer mounting tube, said second spiral plate spiraling parallel to and spaced apart a selected distance from said first spiral plate;

such that the particles become charged and collect on one of the plates and subsequently enter said disposal tube.

2. The apparatus of claim 1, wherein said outer mounting tube is a tubular side wall of a containment housing.

3. The apparatus of claim 1, wherein said first spiral plate and said second spiral plate are spaced from each other a substantially uniform distance.

4. The apparatus of claim 1, wherein said disposal tube and attached said first spiral plate are charged by connection to a first electric terminal pole, and said outer mounting tube and the attached said second spiral plate are charged by connection to a second electric terminal pole having a charge opposite that of the first electric terminal pole.

5. The apparatus of claim 1, wherein said disposal tube is mounted on electrically insulating material to be electrically isolated from the remainder of said apparatus and therefore to sustain the charge applied to it and to the attached said first spiral plate, and wherein said outer mounting tube is also mounted on electrically insulating material to be electrically isolated from the remainder of said apparatus and therefore to sustain the charge applied to it and to the attached second spiral plate.

6. The apparatus of claim 2, wherein said disposal tube and containment housing are coaxial.

7. The apparatus of claim 2, wherein said containment housing has a housing first end wall, and a gas admission passageway opens directly into said housing first end wall;

and wherein said containment housing has a housing second end tapering to a gas release opening spaced radially outward from said disposal tube, such that exhaust gas can pass between said gas release opening and said disposal tube.

8. The apparatus of claim 2, additionally comprising a fan contained within a fan shroud in fluid communication with said containment housing for pulling gas into the containment housing;

wherein said containment housing has a housing first end which opens into said fan shroud.

9. The apparatus of claim 8, wherein said fan has radial fan blades extending from a fan hub rotatably mounted around said disposal tube and driven by drive means.

10. The apparatus of claim 8, wherein said fan shroud comprises a tubular shroud side wall having a radial gas admission passageway and first and second shroud end walls.

11. The apparatus of claim 1, wherein said disposal tube has a radially extending particle exit tube, and wherein particles removed by said plates are driven by gas pressure and flow through said particle exit tube.

12. The apparatus of claim 10, wherein said disposal tube has a disposal tube first end which is rotatably mounted within a tube bearing mounted in said first shroud end wall, through which a disposal tube first end rotatably passes, and said disposal tube has a disposal tube closed second end from which a solid axle segment axially extends into an axle segment bearing; such that said disposal tube and the attached said first spiral plate are rotatable axially relative to said containment housing and the attached said second spiral plate, such that the first spiral plate advances one of toward and away from said second spiral plate as a result of the pitch of the first spiral plate, depending on the direction of disposal tube rotation.

13. The apparatus of claim 1, wherein said disposal tube has a longitudinally advancing exterior thread and said first spiral plate is mounted to and extends radially outward from an internally threaded carriage tube; such that said disposal tube acts as a drive screw and rotation of said disposal tube relative to said carriage tube advances said carriage tube and the attached said first spiral plate one of toward and away from said second spiral plate, depending on the direction of disposal tube rotation.

14. The apparatus of claim 1, additionally comprising an apparatus mounting plate fastened to said shroud having fastener ports such that said mounting plate can be bolted to an apparatus mounting structure.

* * * * *